US009155678B2

(12) United States Patent
Ho et al.

(10) Patent No.: US 9,155,678 B2
(45) Date of Patent: Oct. 13, 2015

(54) APPARATUS OF CARDIOPULMONARY RESUSCITATOR

(71) Applicants: Chan-Hsiao Ho, Hsinchu County (TW); Chih-Chung Chou, Changhua County (TW); Teng-Chun Wu, Hsinchu (TW); Bor-Nian Chuang, Taichung (TW); Shing Chen, Hsinchu County (TW)

(72) Inventors: Chan-Hsiao Ho, Hsinchu County (TW); Chih-Chung Chou, Changhua County (TW); Teng-Chun Wu, Hsinchu (TW); Bor-Nian Chuang, Taichung (TW); Shing Chen, Hsinchu County (TW)

(73) Assignees: INDUSTRIAL TECHNOLOGY RESEARCH INSTITUTE, Hsin-Chu (TW); KING DESIGN INDUSTRIAL CO. LTD., Taipei County (TW)

( * ) Notice: Subject to any disclaimer, the term of this patent is extended or adjusted under 35 U.S.C. 154(b) by 465 days.

(21) Appl. No.: 13/681,619

(22) Filed: Nov. 20, 2012

(65) Prior Publication Data

US 2013/0079688 A1 Mar. 28, 2013

Related U.S. Application Data

(62) Division of application No. 11/686,130, filed on Mar. 14, 2007, now Pat. No. 8,337,436.

(30) Foreign Application Priority Data

Dec. 14, 2006 (TW) ..... 095146823 A

(51) Int. Cl.
*A61H 31/00* (2006.01)
*A61H 9/00* (2006.01)

(52) U.S. Cl.
CPC ..... *A61H 31/00* (2013.01); *A61H 31/006* (2013.01); *A61H 31/008* (2013.01); *A61H 2031/003* (2013.01)

(58) Field of Classification Search
CPC ... A61H 31/00; A61H 31/006; A61H 31/008; A61H 2031/003; A61H 9/0078; A61H 2201/5007
USPC ..... 601/41–44
See application file for complete search history.

(56) References Cited

U.S. PATENT DOCUMENTS

| | | | |
|---|---|---|---|
| 2,071,215 | A | 2/1937 | Petersen |
| 3,552,390 | A | 1/1971 | Muller |
| 3,610,233 | A | 10/1971 | Barkalow |
| 3,782,371 | A | 1/1974 | Derouineau |
| 4,019,501 | A | 4/1977 | Harris |
| 4,077,400 | A | 3/1978 | Harrigan |
| 4,095,590 | A | 6/1978 | Harrigan |
| 4,196,725 | A | 4/1980 | Gunderson |
| 4,237,872 | A | 12/1980 | Harrigan |
| RE30,750 | E | 9/1981 | Diack et al. |
| 4,297,999 | A | 11/1981 | Kitrell |
| 4,326,507 | A | 4/1982 | Barkalow |
| 4,338,924 | A | 7/1982 | Bloom |

(Continued)

FOREIGN PATENT DOCUMENTS

| | | |
|---|---|---|
| TW | 244929 | 12/2005 |

*Primary Examiner* — Quang D Thanh
(74) *Attorney, Agent, or Firm* — WPAT, PC; Justin King

(57) ABSTRACT

The present disclosure discloses an apparatus of cardiopulmonary resuscitator that is operated through a driving mechanism controlled and driven by air power. The driving mechanism functions to actuate a belt adapted to extend around a chest of a patient to generate reciprocating movement of pressing and releasing so as to achieve a purpose of cardiopulmonary resuscitation for recovering heartbeat and breathing of the patent.

9 Claims, 12 Drawing Sheets

(56) References Cited

U.S. PATENT DOCUMENTS 4,355,634 A 10/1982 Kanter
4,424,806 A 1/1984 Newman et al.
4,491,423 A 1/1985 Cohen
4,554,910 A 11/1985 Lally
4,559,940 A 12/1985 McGinnis
4,583,524 A 4/1986 Hutchins
4,702,231 A 10/1987 Arpin
4,770,164 A 9/1988 Lach et al.
4,809,683 A 3/1989 Hanson
4,881,527 A 11/1989 Lerman
4,928,674 A 5/1990 Halperin et al.
4,971,042 A 11/1990 Lerman
5,195,942 A 3/1993 Weil et al.
5,295,481 A 3/1994 Geeham
5,327,887 A 7/1994 Nowakowski
5,353,793 A 10/1994 Bornn
5,551,420 A 9/1996 Lurie et al.
5,579,785 A 12/1996 Bell
5,589,639 A 12/1996 D'Antonio et al.
5,592,938 A 1/1997 Scarberry et al.
5,626,618 A 5/1997 Ward et al.
5,630,789 A 5/1997 Schock et al.
5,645,522 A 7/1997 Lurie et al.
5,657,751 A 8/1997 Karr, Jr.
5,683,424 A 11/1997 Brown et al.
5,692,498 A 12/1997 Lurie et al.
5,693,005 A 12/1997 Vistung
5,716,318 A 2/1998 Manning
5,738,637 A 4/1998 Kelly et al.
5,766,151 A 6/1998 Valley et al.
5,769,800 A 6/1998 Gelfand et al.
5,772,613 A 6/1998 Gelfand et al.
5,814,016 A 9/1998 Valley et al.
5,823,185 A 10/1998 Chang
5,824,071 A 10/1998 Nelson et al.
5,833,711 A 11/1998 Schneider, Sr.
5,885,084 A 3/1999 Pastrick et al.
5,891,062 A 4/1999 Schock et al.
5,931,850 A 8/1999 Zadini et al.
5,934,282 A 8/1999 Young, III et al.
5,957,856 A 9/1999 Weil et al.
5,978,714 A 11/1999 Zadini et al.
5,997,488 A 12/1999 Gelfand et al.
6,000,076 A 12/1999 Webster et al.
6,010,470 A 1/2000 Albery et al.
6,062,219 A 5/2000 Lurie et al.
6,066,106 A 5/2000 Sherman et al.
6,090,056 A 7/2000 Bystrom et al.
6,125,298 A 9/2000 Olson et al.
6,142,962 A 11/2000 Mollenauer et al.
6,171,267 B1 1/2001 Baldwin, II
6,174,295 B1 1/2001 Cantrell et al.
6,179,793 B1 1/2001 Rothman et al.
6,193,680 B1 2/2001 Parsons et al.
6,213,960 B1 4/2001 Sherman et al.
6,224,562 B1 5/2001 Lurie et al.
6,234,984 B1 5/2001 Kelly et al.
6,234,985 B1 5/2001 Lurie et al.
6,287,267 B1 9/2001 Brenneman et al.
6,296,653 B1 10/2001 Zadini et al.
6,306,107 B1 10/2001 Myklebust et al.
6,312,399 B1 11/2001 Lurie et al.
6,325,771 B1 12/2001 Kelly et al.
6,332,872 B1 12/2001 Young
6,334,070 B1 12/2001 Nova et al.
6,351,671 B1 2/2002 Myklebust et al.
6,360,125 B1 3/2002 Weil et al.
6,371,119 B1 4/2002 Zadini et al.
6,374,827 B1 4/2002 Bowden et al.
6,390,996 B1 5/2002 Halperin et al.
6,397,843 B1 6/2002 Tien-Tsai
6,398,744 B2 6/2002 Bystrom et al.
6,398,745 B1 6/2002 Sherman et al.
6,427,685 B1 8/2002 Ray, II
6,440,082 B1 8/2002 Joo et al.
6,447,465 B1 9/2002 Sherman et al.
6,464,629 B1 10/2002 Boone et al.
6,503,265 B1 1/2003 Fogarty et al.
6,526,973 B1 3/2003 Lurie et al.
6,575,914 B2 6/2003 Rock et al.
6,595,912 B2 7/2003 Lau et al.
6,599,258 B1 7/2003 Bystrom et al.
6,602,182 B1 8/2003 Milbocker
6,604,523 B2 8/2003 Lurie et al.
6,616,620 B2 9/2003 Sherman et al.
6,645,163 B2 11/2003 Kelly et al.
6,648,841 B1 11/2003 Sessler
6,676,613 B2 1/2004 Cantrell et al.
6,690,969 B2 2/2004 Bystrom et al.
6,699,259 B2 3/2004 Fogarty et al.
6,709,410 B2 3/2004 Sherman et al.
6,726,639 B2 4/2004 Bassuk et al.
6,735,532 B2 5/2004 Freed et al.
6,752,771 B2 6/2004 Rothman et al.
6,807,442 B1 10/2004 Myklebust et al.
6,814,076 B2 11/2004 Shusterman et al.
6,827,695 B2 12/2004 Palazzolo et al.
6,848,444 B2 2/2005 Smith et al.
6,858,016 B2 2/2005 Davaris et al.
6,863,656 B2 3/2005 Lurie
6,865,413 B2 3/2005 Halperin et al.
6,869,408 B2 3/2005 Sherman et al.
6,869,409 B2 3/2005 Rothman et al.
6,913,600 B2 7/2005 Valley et al.
6,926,682 B2 8/2005 Bystrom et al.
6,938,618 B2 9/2005 Lurie et al.
6,939,314 B2 9/2005 Hall et al.
6,939,315 B2 9/2005 Sherman et al.
6,944,485 B1 9/2005 Van Meter et al.
6,969,349 B1 11/2005 Spence et al.
6,986,349 B2 1/2006 Lurie
6,988,499 B2 1/2006 Holt et al.
7,008,388 B2 3/2006 Sherman et al.
7,011,637 B2 3/2006 Sherman et al.
7,056,295 B2 6/2006 Halperin
2002/0026131 A1* 2/2002 Halperin ..... 601/41
2004/0193076 A1 9/2004 Sherman et al.
2006/0009717 A1 1/2006 Hall et al.

* cited by examiner

APPARATUS OF CARDIOPULMONARY RESUSCITATOR

CROSS REFERENCE TO RELATED PATENT APPLICATION

This application is a divisional of an application Ser. No. 11/686,130, filed on Mar. 14, 2007.

FIELD OF THE DISCLOSURE

The present disclosure relates to a chest compression apparatus, and relates to an apparatus of cardiopulmonary resuscitator.

BACKGROUND OF THE DISCLOSURE

The American Heart Association (AHA) has estimated that over 350,000 individuals in the United States experience a sudden cardiac arrest (SCA) each year, which is a sudden, abrupt loss of heart function resulting in sudden cardiac death within minutes of onset. Unfortunately, 95 percent of SCA victims die because cardiopulmonary resuscitation (CPR) isn't provided soon enough.

CPR is the abbreviation for cardio pulmonary resuscitation, and is an emergency technique applied by combining artificial respiration and massage outside the heart, when breathing stops and the heart stops beating. Due to brain damage is likely to occur in just 4 to 6 minutes without oxygen supplying, and irreparable brain damage will be further caused while there is no oxygen supplying in more than 6 minutes. Accordingly, if the CPR is provided promptly, the breathing and circulation can be maintained to provide oxygen and blood flow to the brain so as to sustain life of patient in time. In another words, any cause of breath cease and cardiac arrest, including drowning, heart attack, car accident, electric shock, drug poisoning, gas poisoning and airway obstruction, before getting proper medical care, CPR is a effective choice to keep the brain cell and other organs from being damaged. With the merits of CPR described above, right now, the AHA trains more than 9 million people a year and it is determined to more than double that number, to 20 million, within the next five years.

However, manual CPR, even operated properly, will not provide enough efficiency to maintain the normal circulation of blood flowing to brain or heart due to, during processing CPR, the effectiveness getting decreased in occasions such as inadequate chest compression, rescuer fatigue, and moving patient by rescuer. Therefore, it has been a vital topic for the one skilled in this field to spend efforts providing an apparatus of cardiopulmonary resuscitator for overcoming the drawbacks of manual CPR.

Conventional technique for solve the above problem of manual CPR, such as U.S. Pat. No. 6,171,267 applied by Michigan Instruments, Inc. in 1999, discloses a high impulse cardiopulmonary resuscitator shown in FIG. 1. The cardiopulmonary resuscitation method and apparatus that is adapted to performing high-impulse CPR includes providing a chamber having an expandable volume and a patient-contacting pad that moves as a function of volume of the chamber and supplying a controlled quantity of a fluid to the chamber. This results in increasing the chamber volume by a controlled amount, thereby compressing the patient's chest with the patient-contacting pad during a systolic phase.

Please refer to FIG. 1, the apparatus comprises a base 11, a column 12 supported by the base 11, and a cardiopulmonary resuscitation arm assembly 13 adjustably supported along the column 12. The cardiopulmonary resuscitation arm assembly 13 has a fluid control system additionally including a timing circuit, a control valve assembly and a pressure regulator. A flexible pressure hose 14 interconnects the portion of the pneumatic source providing pneumatic power. The timing circuit is selectively to operate to control valve assembly so as to control operating frequency and pressing depth of a massage pad 15.

Another conventional way, such as U.S. Pat. No. 6,398,745 of Revivant Corporation, discloses a modular CPR assist device shown in FIG. 2A and FIG. 2B. The device includes a panel 20, a motor box 21 and a drive spool 22 driven by the motor box 21, a belt 23 and a computer module 24. The computer module 24 is programmed and operated to repeatedly turn the motor and release the clutch inside the motor box 21 to roll the compression belt 23 onto the drive spool 22 and release the drive spool 22 to allow the belt 23 to unroll so as to generate massage effect to the patient. The merits of the device can avoid causing injury to the chest during the operation and improve the efficiency of the compression.

SUMMARY OF THE DISCLOSURE

The present disclosure is to provide a cardiopulmonary resuscitator actuating a belt around chest of a patient to generate reciprocating movement through a pneumatic power controlled by a controlling module so as to achieve a purpose of cardiac massage.

The present disclosure is to provide a cardiopulmonary resuscitator controlled and driven through a pneumatic power so as to actuate a belt around chest of a patient to generate reciprocating movement, wherein the cardiopulmonary resuscitator is capable of being driven without any electrical device so that the cardiopulmonary resuscitator my be used in outdoor environment or circumstances without supplying of electrical power.

The present disclosure is to provide a cardiopulmonary resuscitator with a massage mechanism actuated by the pneumatic power to drive the belt around the chest of the patient so as to achieve a purpose of simplifying the mechanical design.

The present disclosure provides a cardiopulmonary resuscitator, comprising: a panel for supporting a patient; a first belt, disposed at a side of the panel, for wrapping around the chest of the patient; a driving device, connected to the first belt and driven by a pneumatic source to cyclically tighten and loosen the first belt around the chest of the patient; and a controlling module, coupled to the pneumatic source, functioning to control and adjust the pneumatic power generated by the pneumatic source.

In addition, the present disclosure further provides a cardiopulmonary resuscitator, comprising a panel for supporting a patient; a first belt, disposed at a side of the panel, wrapping around the chest of the patient; a flexible body, disposed on one side of the panel opposite to the side for supporting the patient, functioning to tighten and loosen the first belt for compressing and releasing the chest of the patent through a inflating and deflating motion generated by a pneumatic power; and a controlling module, connected to a pneumatic source, being capable of adjusting the airflow provided from the pneumatic source to pass in and out the flexible body.

Other aspects and advantages of the present disclosure will become apparent from the following detailed description, taken in conjunction with the accompanying drawings, illustrating by way of example the principles of the present disclosure.

BRIEF DESCRIPTION OF THE DRAWINGS

The drawings, incorporated into and form a part of the disclosure, illustrate the embodiments and method related to this disclosure and will assist in explaining the detail of the disclosure.

DESCRIPTION OF THE PREFERRED EMBODIMENT

For your esteemed members of reviewing committee to further understand and recognize the fulfilled functions and structural characteristics of the disclosure, several preferable embodiments cooperating with detailed description are presented as the follows.

Figure 1:
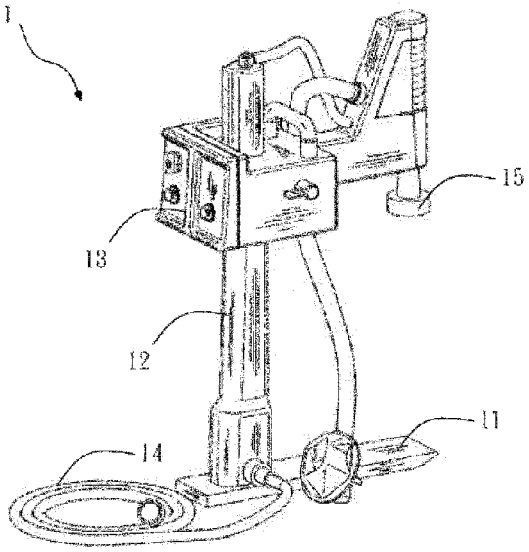
FIG. 1 (PRIOR ART)
FIG. 1 is a perspective view of a conventional cardiopulmonary resuscitator.
Figure 2A:
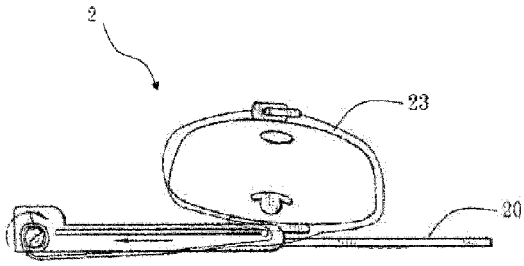
FIG. 2A (PRIOR ART)
FIG. 2A.
Figure 2B:
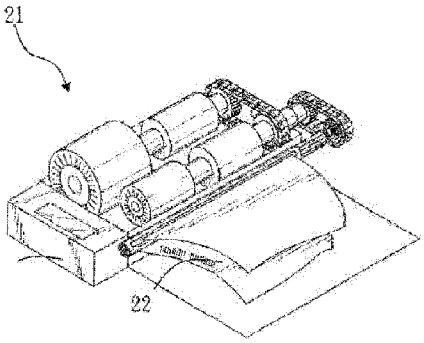
FIG. 2B (PRIOR ART)
FIG. 2B illustrate another conventional cardiopulmonary resuscitator.
Figure 3A:
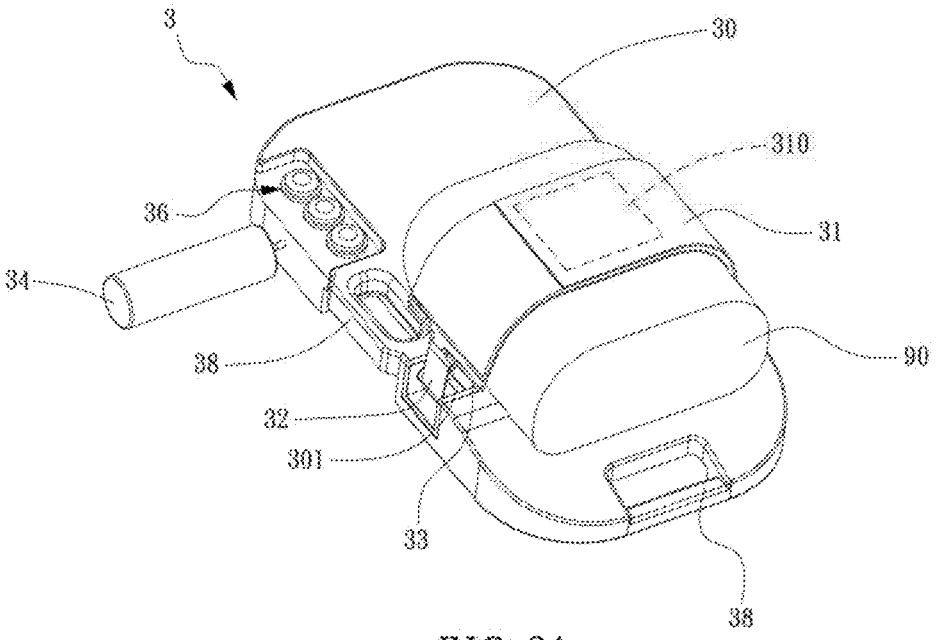
FIG. 3A illustrates a perspective view of the first embodiment of a cardiopulmonary resuscitator according to the present disclosure.
Figure 3B:
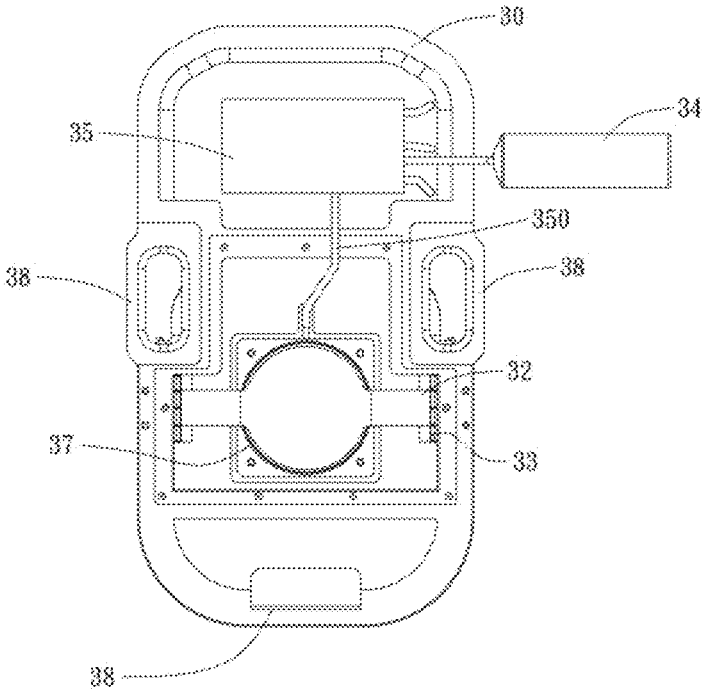
FIG. 3B illustrates a bottom view of the first embodiment of a cardiopulmonary resuscitator according to the present disclosure.

Please refer to FIG. 3A and FIG. 3B, wherein FIG. 3A is a perspective view of the first embodiment of a cardiopulmonary resuscitator according to the present disclosure and FIG. 3B illustrates a bottom view of the first embodiment of a cardiopulmonary resuscitator according to the present disclosure. The cardiopulmonary resuscitator 3 comprises a panel 30, a first belt 31, a flexible body 37, and a controlling module 35. The panel 30 is capable of supporting a patient. There is at least one handle 38 disposed around the side of the panel 30 so as to increase the portability of the cardiopulmonary resuscitator 3; in this embodiment, two of the handles 38 are disposed on the two sides of the panel 30 and another handle 38 is disposed on the front of the panel 30. The first belt 31, disposed at a side of the panel 30, for wrapping around the chest of the patient 90. The first belt 31 further has a fastener 310 for appropriately adjusting the first belt 31 according to the size of chest of the patient 90. In the embodiment of the present disclosure, the fastener 310 is a hook-and-loop fastener, but should not be a limitation of the present disclosure. The flexible body 37, disposed on the bottom of the panel 30, has an accommodation space for allowing air flow in and out so that the flexible body 37 can generate an inflating and deflating movement to cyclically tighten and loosen the first belt 31 for compressing and releasing the chest of patient 90. The flexible body 37 in this embodiment is a bladder.

The controlling module 35, coupled to a pneumatic source 34 and the flexible body 37, is capable of controlling airflow provided from the pneumatic source 34 to pass in and out of the accommodation space of the flexible body 37. In the embodiment, the pneumatic source 34 is a high-pressure bottle for providing airflow to the flexible body. In addition, an operating panel 36 with plural turn knobs or bottom is coupled to the controlling module 35 for controlling the flowing rate to the flexible body 37. The controlling module 35 connects to the flexible body 37 with pipes 350 so that the flexible body 37 can receive and exhaust air through the pipes 350.

Meanwhile, the panel 30 further has two openings 301 on two opposite sides thereof for allowing two ends of a second belt 32 to pass therethrough. The second belt 32 contacts with the flexible body and its two ends connect to the two ends of the first belt with a buckle 33 respectively. Preferably, a fastener (not shown) such as hook-and-loop fastener is disposed between the flexible body 37 and the second belt 32 for enforcing the adhesive force between the second belt 32 and the flexible body 37. A plurality of rollers 39, shown in FIG. 4A, are disposed at the bottom of the panel 30 to contact with the second belt 32 for providing action force to the second belt 32 so as to increase and adjust the tension force of the second belt 32.

Figure 4A:
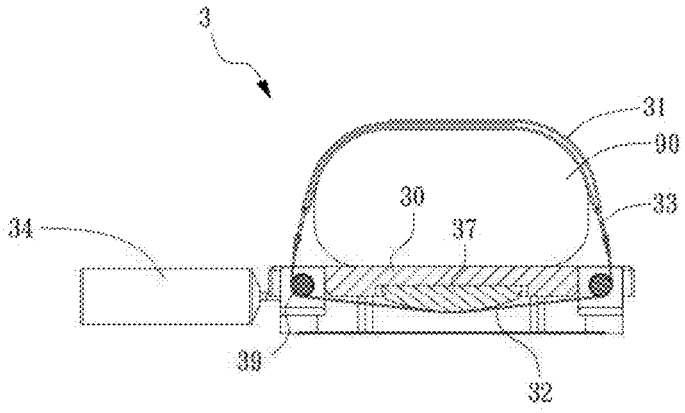
FIG. 4A and FIG. 4B illustrate the operation of the first embodiment of the cardiopulmonary resuscitator according to the present disclosure.
Figure 4B:
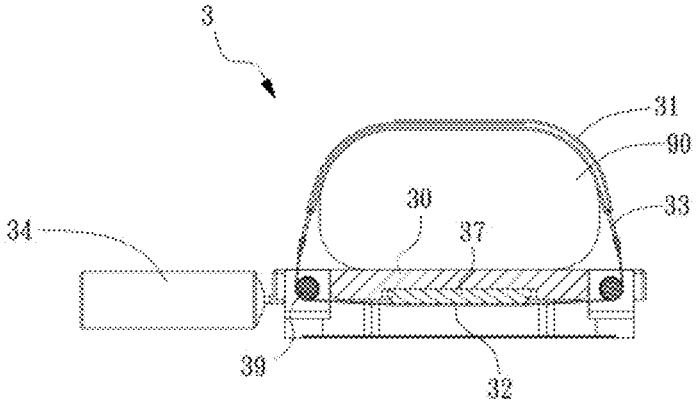

Please refer to FIG. 4A and FIG. 4B, which illustrate the operation of the first embodiment of the cardiopulmonary resuscitator according to the present disclosure. The patient 90 lies down the panel 30 and the first belt 31 wraps the chest of the patient 90. By means of the controlling module controlling the pneumatic pressure inside the flexible body 37, the flexible body 37 inflates, shown in FIG. 4A, to actuate the second belt 32 pulling the first belt 31 through the buckle 33. Once the first belt 31 is pulled, the first belt 31 will tighten to compress the chest of the patient 90. Please refer to FIG. 4B, the controlling module controls the air to pass out of the flexible body 37 which deflates the flexible body 37 so that the second belt 32 returns to the original status to loosen the first belt 31 so as to release the chest of the patient 90. With the cyclic movement of the first belt 31 shown in FIG. 4A and FIG. 4B, the pressure inside the chest of the patient 90 increases to push the blood in circulation so as to prevent the irreparable brain damage caused by a lack of oxygen from occurring.

Returning to FIG. 3A and FIG. 3B, in this embodiment, the emergency operator setup condition through turn knob of the control panel 36 according to the age, the type of build, and gender of the patient so that the controlling module 35 can be operated in an appropriate manner in accordance with the setup of the control panel. In the embodiment of the present disclosure, the compression frequency can be configured between 50 times per minutes to 100 times per minutes; meanwhile, the inflating range of the flexible body 37 is up to 4 to 8 centimeter while the compression force is between 30 to 60 kilogram.

In the embodiment, the controlling module 35 is a module of mechanical air control valve, which is capable of providing steady airflow to the flexible body 37 during chest compression, reducing environmental influence, and avoiding breaking down usually arisen from the electrical controlling module utilized in the conventional cardiopulmonary resuscitator, so as to improve the reliability and stability and increase use occasions of the cardiopulmonary resuscitator.

Figure 4C:
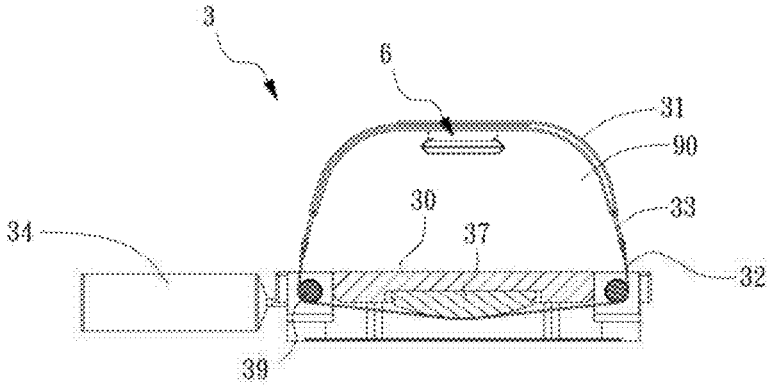
FIG. 4C is a schematic illustration of a massage pad disposed in the first embodiment.

Please refer to FIG. 4C, a massage pad 6 is disposed on the first belt 31 toward the chest of the patient to concentrate a compression force to the center of the chest of the patient 90. The massage pad 6 is made of rubber and is removably attached to the first belt 31 through hook-and-loop fastener so that the emergency operators may optionally decide whether to use the massage pad 6 or not according the patient status.

Figure 5:
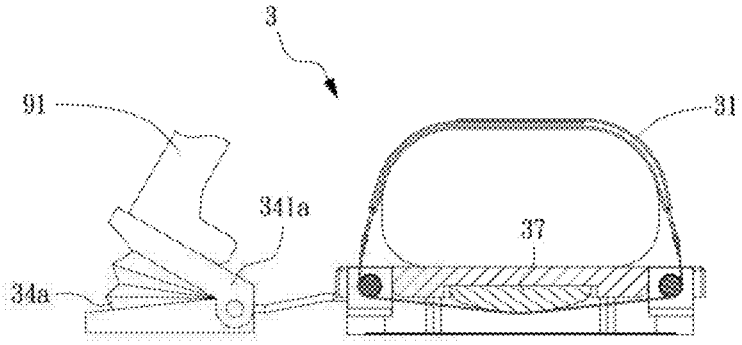
FIG. 5 illustrates another embodiment of pneumatic source in the present disclosure.

Please refer to FIG. 5, which illustrates another embodiment of pneumatic source in the present disclosure. In the embodiment of FIG. 5, the pneumatic source 34*a* is an inflator with a pedal 341*a* disposed thereon. The operator's foot 91 can step on the pedal 341*a* through a cyclical motion to compress the inflator so that the inflator can provide airflow to inflate and deflate the flexible body 37 so as to tighten and loosed the first belt 31 around the chest of the patient for providing the compression force toward the chest of the patient.

Figure 6A:
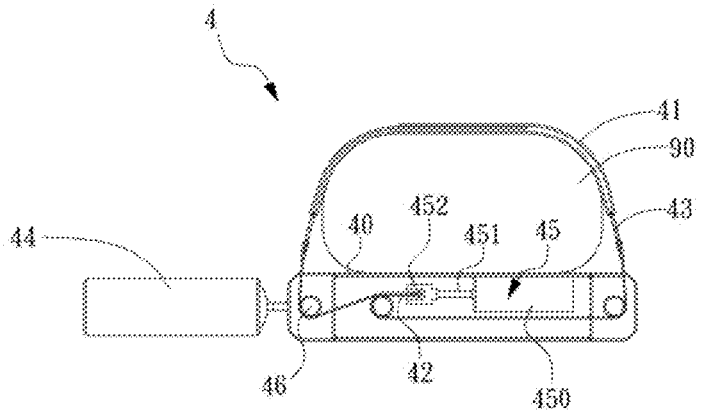
FIG. 6A and FIG. 6B illustrates a second embodiment of cardiopulmonary resuscitator according to the present disclosure.
Figure 6B:
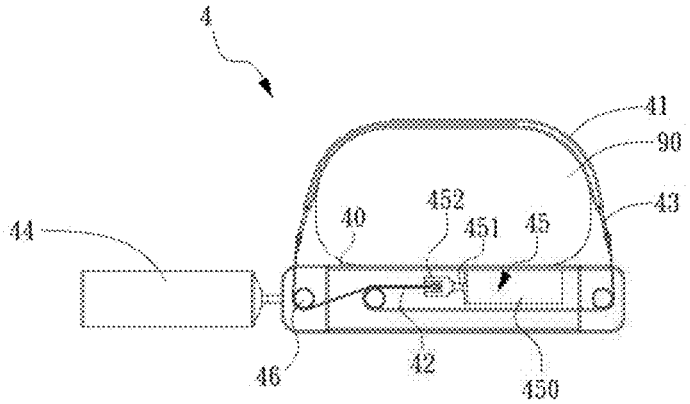

Please refer to FIGS. 6A and 6B, which illustrates a second embodiment of cardiopulmonary resuscitator according to the present disclosure. In the embodiment, the cardiopulmonary resuscitator 4 comprises a panel 40, a first belt 41, and controlling module (not shown in figure) and a driving device 45. The panel 40, the first belt 41, and the controlling module are the same as the embodiment described previously.

The driving device 45 has an air cylinder 450, a piston rod 451 and a fastener 452. The air cylinder 450 actuates the piston rod 451 to generate a linear reciprocating motion through the pneumatic power from the pneumatic source 44. The fastener 452, disposed in the front end of the piston rod 451, functions to clamp a second belt 42. The two ends of the second belt 42 connect to the two ends of the first belt 41 with a buckle 43 respectively. A plurality of rollers 46, disposed on the bottom side of the panel 40, contact to the second belt for providing action force to the second belt 42 so as to adjust the tension force of the second belt 42.

By means of the controlling module controlling the pneumatic source 44 to provide airflow into the air cylinder 450, the air cylinder 450 will actuate the piston rod 451 moving back and forth to tighten and loosen the second belt 42 so as to pull the first belt 41 to compress and release toward the chest of the patient 90. In FIG. 6A, the piston rod 451 extending outward to loosen the second belt 42 for releasing the first belt 41, while in the FIG. 6B, the piston rod 452 moving backward to pullback the second belt 42 so as to make the first belt 41 compress the chest of the patient 90.

Just like the previous embodiment, the emergency operator setup condition through turn knob of the control panel (not shown, but the same as the previous embodiment) according to the age, the type of build, and gender of the patient 90 so that the controlling module can be operated in an appropriate manner in accordance with the setup of the control panel. In the embodiment of the present disclosure, the compression frequency can be configured between 50 times per minutes to 100 times per minutes; meanwhile, the piston stroke can be controlled between 3 to 6 centimeter while the compression force is between 30 to 60 kilogram.

Figure 7A:
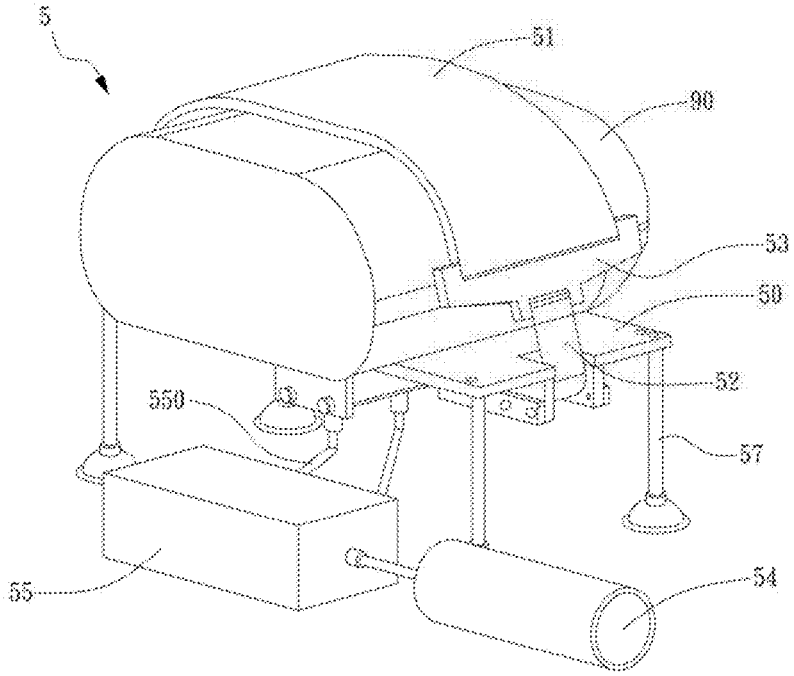
FIG. 7A and FIG. 7B illustrates a third embodiment of cardiopulmonary resuscitator according to the present disclosure.
Figure 7B:
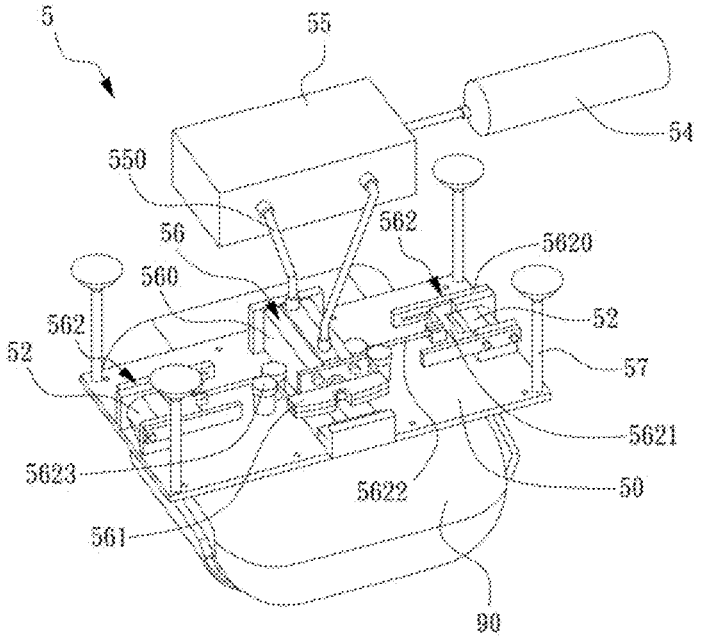

Please refer to FIG. 7A and FIG. 7B, which illustrates a third embodiment of cardiopulmonary resuscitator according to the present disclosure. In this embodiment, the cardiopulmonary resuscitator 5 has a panel 50 for supporting a patient 90, a first belt 51, a controlling module 55, and a driving device 56. The panel 50 has four supporters 57 disposed at four edges of the bottom side of the panel 50. The panel 50, the first belt 51 and the controlling module 55 are the same as the embodiment described before, it will not be further described hereafter.

The driving device 56 includes an air cylinder 560, a clamping member 561, a pair of second belts 52, and a pair of holders 562. The air cylinder 560 disposed on the bottom of the panel 50 communicates with the controlling module 55 through air piping 550. The air cylinder 560 actuates a piston rod disposed thereon to generate a linear reciprocating motion through the pneumatic power from the pneumatic source 54. The clamping member 561 connects to the piston rod. The two ends for each of the second belt 52 connect to the one end of the first belt 51 and the holder 562 respectively. The pair of the holders, disposed at two sides of the air cylinder 560 respectively, connect to the clamping member 561.

The holder 562 further has a frame 5620 for sliding, a slider 5621, and a strap 5622. The frame 5620 for sliding is disposed on the bottom side of the panel 50. The slider 5621 disposed on the frame 5620 for sliding connects to the end of the second belt 52. The strap 5622 has two ends, wherein one end is connected to the slider 5621 and another end is connected to the clamping member 561. The bottom side of the panel 50 further includes plural rollers 5623 contacting with the strap 5622 for adjusting the tension force of the strap 5622.

By means of the controlling module 55 to control the pneumatic power provided by the pneumatic source 54, the air cylinder 560 actuates the piston rod to move back and forth so as to drive the slider 5621 to generate a reciprocating motion through the clamping member 561 and the strap 5622. Since the second belt 52 is a relaying element connecting to the slider 5621 and the first belt 51, the first belt 51 will become tightened and loosened to massage the chest of the patient 90 through the reciprocating motion of the second belt 52 driven by the air cylinder 560.

While the preferred embodiment of the disclosure has been set forth for the purpose of disclosure, modifications of the disclosed embodiment of the disclosure as well as other embodiments thereof may occur to those skilled in the art. Accordingly, the appended claims are intended to cover all embodiments which do not depart from the spirit and scope of the disclosure.

What is claimed is:

1. A cardiopulmonary resuscitator, comprising:

a panel for supporting a patient;

a first belt, disposed at a side of the panel, for wrapping around a chest of the patient;

a flexible body, disposed on one side of the panel opposite to the side for supporting the patient, functioning to tighten and loosen the first belt for compressing and releasing the chest of the patient through a inflating and deflating motion generated by a pneumatic power; and a controlling module, connected to a pneumatic source, being capable of adjusting the airflow provided from the pneumatic source to pass in and out the flexible body.

2. The cardiopulmonary resuscitator according to claim 1, wherein the flexible body is a bladder.

3. The cardiopulmonary resuscitator according to claim 1, further comprises a second belt with two ends connecting to two ends of the first belt respectively and contacting with the flexible body.

4. The cardiopulmonary resuscitator according to claim 3, wherein there is a buckle disposed between the first belt and the second belt.

5. The cardiopulmonary resuscitator according to claim 3, further comprises a hook-and-loop fastener disposed between the second belt and the flexible body for attaching the flexible body to the second belt.

6. The cardiopulmonary resuscitator according to claim 1, wherein the pneumatic source is selected from a group consisting a high pressure bottle and a inflator, which generates air through a compression and inflation movement operated by a action force.

7. The cardiopulmonary resuscitator according to claim 1, further comprising a massage pad, made of a rubber material and disposed on side of the first belt toward the chest of the patient.

8. The cardiopulmonary resuscitator according to claim 1, wherein the panel further comprises a handle for carrying.

9. The cardiopulmonary resuscitator according to claim 1, wherein the first belt further comprises a fastener for adjusting the first belt according to size of the chest of the patient.

* * * * *